US007670570B2

(12) United States Patent
Brück et al.

(10) Patent No.: US 7,670,570 B2
(45) Date of Patent: Mar. 2, 2010

(54) CASING TUBE WITH THERMALLY INSULATING BEADS

(75) Inventors: Rolf Brück, Bergisch Gladbach (DE); Peter Hirth, Lohmar (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 2251 days.

(21) Appl. No.: 10/308,078

(22) Filed: Dec. 2, 2002

(65) Prior Publication Data

US 2003/0086836 A1 May 8, 2003

Related U.S. Application Data

(63) Continuation of application No. PCT/EP01/05688, filed on May 18, 2001.

(30) Foreign Application Priority Data

Jun. 2, 2000 (DE) ..... 100 27 404

(51) Int. Cl.
*F01N 3/28* (2006.01)

(52) U.S. Cl. ..... 422/179; 422/168; 422/177; 422/180

(58) Field of Classification Search ..... 422/177, 422/179, 180, 171; 60/299
See application file for complete search history.

(56) References Cited

U.S. PATENT DOCUMENTS

| | | | | |
|---|---|---|---|---|
| 4,158,037 A | | 6/1979 | Aoyama | 422/179 |
| 4,282,186 A | | 8/1981 | Nonnenmann et al. | 422/180 |
| 4,842,310 A | | 6/1989 | Muffke et al. | 285/334.5 |
| 4,909,994 A | | 3/1990 | Nishizawa et al. | 422/180 |
| 5,104,627 A | | 4/1992 | Usui et al. | 422/171 |
| 5,116,581 A | * | 5/1992 | Cyron et al. | 422/180 |

(Continued)

FOREIGN PATENT DOCUMENTS

DE 33 38 899 A1 10/1984

(Continued)

OTHER PUBLICATIONS

English Translation of DE 100 32 023 A1. Translated by The McElroy Translation Company. Jan. 2008.*

*Primary Examiner*—Jennifer A Leung
(74) *Attorney, Agent, or Firm*—Laurence A. Greenberg; Werner H. Stemer; Ralph E. Locher

(57) ABSTRACT

A casing tube is provided for a honeycomb element used for exhaust gas treatment. The casing tube is provided with a first area which is located close to a first front face and a third area which is located to close a second front face. The casing tube has a first inner diameter in the first and third area and is provided with a second area that is disposed between the first and the third area. The second area has a second inner diameter that is larger than the first inner diameter. The casing tube is characterized in that the axial length of the first area is less than 5 mm, preferably less than 3 mm. The relatively narrow first area enables the honeycomb to be permanently fixed and ensures that only a small amount of heat is transmitted to the casing tube. As a result, a significant improvement is achieved in the cold start performance of a catalytic converter.

15 Claims, 1 Drawing Sheet

U.S. PATENT DOCUMENTS

| | | | | |
|---|---|---|---|---|
| 5,278,125 | A | 1/1994 | Iida et al. | 502/439 |
| 5,413,767 | A * | 5/1995 | Breuer et al. | 422/180 |
| 5,916,530 | A | 6/1999 | Maus et al. | 422/179 |

FOREIGN PATENT DOCUMENTS

| | | | |
|---|---|---|---|
| DE | 195 21 583 | A1 | 12/1996 |
| DE | 196 27 289 | A1 | 12/1997 |
| DE | 10032023 | A1 * | 1/2002 |
| EP | 0 205 895 | A1 | 12/1986 |
| EP | 0 505 720 | A1 | 9/1992 |
| WO | WO 9013736 | A1 * | 11/1990 |

* cited by examiner

CASING TUBE WITH THERMALLY INSULATING BEADS

CROSS-REFERENCE TO RELATED APPLICATION

This application is a continuation of copending International Application No. PCT/EP01/05688, filed May 18, 2001, which designated the United States and was not published in English.

BACKGROUND OF THE INVENTION

Field of the Invention

The present invention relates to a casing tube, in particular for a honeycomb body for treating exhaust-gases. The casing tube has a first zone close to a first end face and a third zone close to a second end face. The casing tube further has a first internal diameter in the first zone and the third zone and furthermore has a second zone disposed between the first and third zones. The second zone has a second internal diameter that is greater than the first internal diameter. The present invention also relates to a catalytic converter having such a casing tube. Catalytic converters of this type are preferably used in an exhaust system of an internal combustion engine.

Currently, various concepts aimed at limiting exhaust emissions are being pursued in order to comply with exhaust emission regulations, which are becoming increasingly stringent throughout the world. In this context, in particular the emissions from the exhaust system after a cold start of an internal combustion engine are very much in the foreground. Catalytic converters are used to purify the exhaust gas. The catalytic converters have a catalytically active surface, which above a certain temperature (approximately 250° C.) effects chemical conversion of pollutants in the exhaust gas (e.g. carbon monoxide, hydrocarbons, nitrogen oxides). It is important to minimize the time that is required for the catalytic converter to reach a light-off temperature.

U.S. Pat. No. 4,282,186 discloses a catalytic converter for purifying exhaust gases from an internal combustion engine of a motor vehicle having a support matrix of bound metal foils and a casing tube. Close to its end faces, the casing tube has a smaller internal diameter than in a central region. The support matrix is fixed in place by end-side regions of the casing tube, which have a smaller internal diameter, an additional welded or brazened joint being proposed to secure this pressure fit. On account of the larger internal diameter in the central region of the casing tube, the catalytic converter has an encircling clear space in the central region. The clear space is used as an insulating damper that prevents heat transfer from the support matrix to the casing tube in this region.

The hot exhaust gas from the internal combustion engine flows through the known catalytic converter, a temperature gradient forming from a gas inlet side to a gas outlet side in particular during the cold start phase. Accordingly, the support matrix first reaches the required light-off temperature of approximately 250° C. close to the gas inlet side. The catalytic reaction takes place exothermically, i.e. releases thermal energy, with the result that downstream regions of the support matrix are additionally heated. This heating characteristic was not taken into account in the symmetrical configuration of the known catalytic converter.

SUMMARY OF THE INVENTION

It is accordingly an object of the invention to provide a casing tube with thermally insulating beads that overcomes the above-mentioned disadvantages of the prior art devices of this general type, which improves the cold-starting performance of the catalytic converter and allows a permanent joining to be produced between the casing tube and the catalyst support body.

With the foregoing and other objects in view there is provided, in accordance with the invention, a casing tube. The casing tube contains a first end face and a first zone disposed downstream of and in a vicinity of the first end face. The first zone has a first internal diameter and an axial length of less than 5 mm. A second zone is disposed downstream of the first zone, the second zone has a second internal diameter greater than the first internal diameter. A second end face is provided along with a third zone disposed between the second zone and the second end face. The third zone has a third internal diameter equal to the first internal diameter.

The casing tube according to the invention has the first zone close to the first end face and the third zone close to the second end face. The casing tube has a first internal diameter in the first zone and in the third zone. Furthermore, the casing tube has the second zone, which is disposed between the first zone and the third zone, the second zone having a second internal diameter, which is greater than the first internal diameter. The casing tube according to the invention is distinguished by the fact that the first zone has an axial length of less than 5 mm. It is preferable for the first zone to be configured with an axial length of less than 3 mm.

The first and third zones having the smaller first internal diameter make it possible, for example, to connect the casing tube to a support body by joining techniques if the support body is configured in such a way that it is in contact with the casing tube in these zones. The connection by joining techniques can be produced, for example, by a known brazing process.

On account of the temperature profile when a catalytic converter is heated in an exhaust system, the first zone is configured to be relatively narrow. The result of this is that the contact between the casing tube and the support matrix is limited to a few millimeters in the vicinity of the first end face, reducing dissipation of heat from the support body to the casing tube.

According to a further embodiment, the first zone of the casing tube has a length of at least 1.5 mm. Casing tubes of this type are used in particular for catalytic converters in an exhaust system of an internal combustion engine. The casing tube and the catalyst support body are subject to high dynamic and thermal loads. To enable the first zone to ensure permanent fixing of the support body in the casing tube, a length of at least 1.5 mm is required in order to form a connection by joining techniques.

According to a further configuration, the second zone has an extent of 10 to 40 mm. An embodiment in which the second zone has an extent of 10 to 20 mm is preferred. In a catalytic converter, the extent of the second zone of the casing tube defines the region in which contact between the catalyst support body and the casing tube is suppressed and therefore dissipation of heat is also prevented. Since the support body heats up rapidly on account of the exothermic reaction involved in catalytic conversion, it is sufficient for the contact between the support body and the casing tube to be interrupted only at the location close to which the light-off temperature is reached after only a short time.

According to yet another embodiment, the second internal diameter is at least 0.4 mm, preferably 2 mm, greater than the first internal diameter. In this way, the distance between the casing tube and the catalyst support body in the second zone is defined. The catalyst support body expands in the second zone during the cold-start phase, on account of the increasing temperature. To prevent contact between the support body and the casing tube, a radial distance of at least 0.2 mm is required.

According to yet another embodiment, the axial extent of the second zone is at least five times, preferably at least ten times, as great as the difference between the first internal diameter and the second internal diameter. Therefore, for example that with a second internal diameter which is 2 mm greater than the first internal diameter, the axial extent of the second zone is at least 10, preferably at least 20 mm.

According to a further configuration of the casing tube, the third zone has an axial dimension, the axial dimension being greater than the length of the first zone and/or the extent of the second zone. Accordingly, the third zone is configured to be relatively wide, with the result that permanent connection to the catalyst support body in the third zone by joining techniques is ensured. It is particularly advantageous if the third zone has an axial dimension of 10 to 50 mm.

According to yet another embodiment, the casing tube has a thickness of 0.1 to 1.5 mm. This low thickness has the advantage that the casing tube presents a lower thermal mass.

Furthermore, the invention proposes a catalytic converter having the casing tube according to the invention, which is suitable in particular for use in an exhaust system of an internal combustion engine. The catalytic converter has a honeycomb body containing sheet-metal layers, the honeycomb body at least in part being structured in such a way that an exhaust gas can go through it in a direction of flow. The first zone of the casing tube is in this case disposed close to an inlet end side and the third zone is disposed close to an outlet end side of the catalytic converter. The honeycomb body is connected to the casing tube by joining techniques in the first zone and the third zone.

On account of the direction of flow of the exhaust gas, the catalytic converter has a hotter inlet side during the cold start phase. Accordingly, the casing tube is oriented in such a way that the first zone is disposed close to the inlet side of the catalytic converter. The honeycomb body takes up heat as a result of the exhaust gas flowing through it and is heated up. On account of the flow characteristics of the exhaust gas, only a relatively small quantity of the exhaust gas flows through radially outer regions of the honeycomb body, with the result that these regions are heated more slowly. To reduce dissipation of thermal energy in the vicinity of the inlet end side, the first zone of the casing tube is configured to be relatively narrow, with the result that contact between the casing tube and the honeycomb body is reduced. The narrow contact region is also ensured with a casing tube which projects beyond the inlet end side of the honeycomb body. In this configuration, it extends from the inlet end side of the honeycomb body to the second zone of the casing tube. This ensures more rapid heating of the honeycomb body in the vicinity of the inlet end side.

According to a further embodiment, a cavity holding air is disposed between the casing tube and the honeycomb body in the second zone. The cavity holding air serves as an insulator which prevents heat transfer from the honeycomb body which is heating up to the casing tube, which is still cool.

Other features which are considered as characteristic for the invention are set forth in the appended claims.

Although the invention is illustrated and described herein as embodied in a casing tube with thermally insulating beads, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
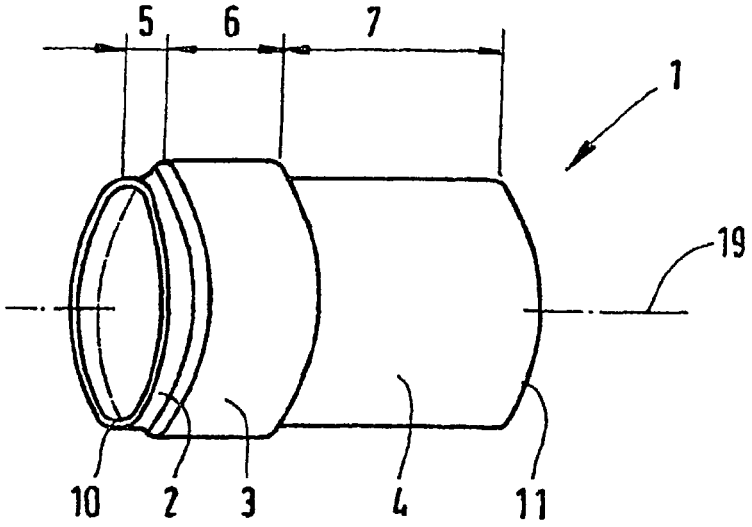
FIG. 1 is a diagrammatic, perspective view of a casing tube according to the invention.

Referring now to the figures of the drawing in detail and first, particularly, to FIG. 1 thereof, there is shown a perspective view of a casing tube 1 according to the invention. The casing tube 1 has a longitudinal axis 19. The casing tube 1 has a first zone 2 close to a first end face 10 and a third zone 4 close to a second end face 11. In the first zone 2 and the third zone 4, the casing tube 1 has a first internal diameter 8. Furthermore, the casing tube 1 has a second zone 3, which is disposed between the first zone 2 and the third zone 4. A second internal diameter 9 of the second zone 3 is greater than the first internal diameter 8. The first zone 2 has an axial length 5 of less than 5 mm, preferably less than 3 mm. The first zone 2 is adjoined by the second zone 3, with an axial extent 6, the extent 6 being between 10 and 40 mm. The third zone 4 has an axial dimension 7 that is greater than the length 5 of the first zone 2 and/or the extent 6 of the second zone 3.

Figure 2:
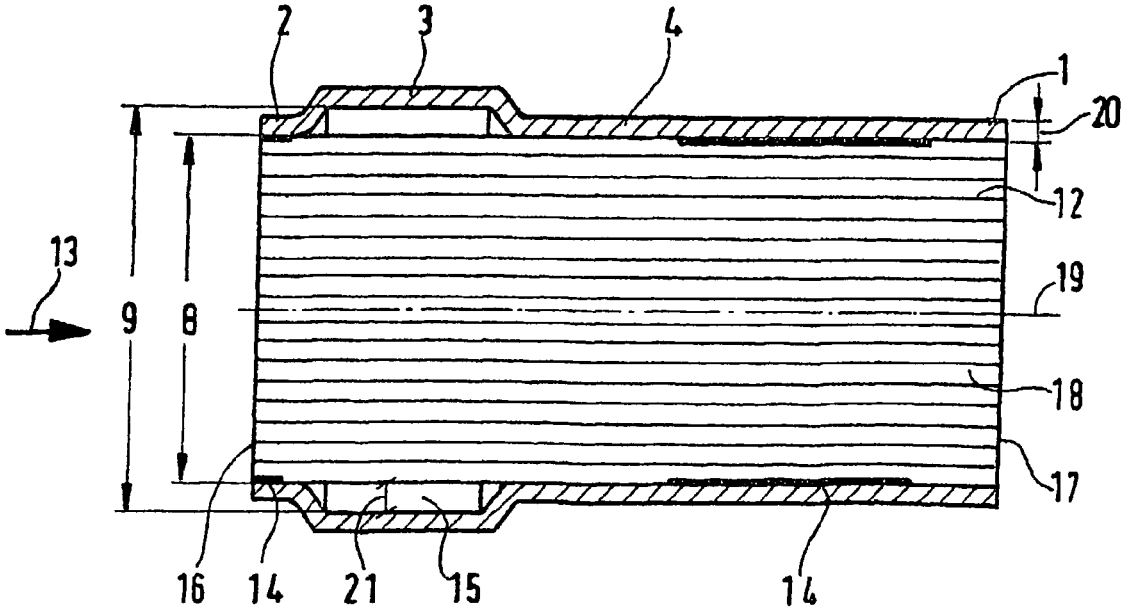
FIG. 2 is a longitudinal sectional view through an embodiment of the casing tube according to the invention with a honeycomb body.

FIG. 2 shows a longitudinal section through an embodiment of a catalytic converter having the casing tube 1 and a honeycomb body 12. An exhaust gas can flow through the honeycomb body 12 in a direction of flow 13. Accordingly, the catalytic converter has an inlet end side 16 and an outlet end side 17.

The casing tube 1 is disposed in such a way that the first zone 2 is disposed close to the inlet end side 16. A connection 14 by joining techniques to the honeycomb body 12 is formed in the region of the first zone 2. The honeycomb body 12 illustrated has sheet-metal layers 18 which at least in part are structured in such a way that the exhaust gas can flow through the honeycomb 12. For this reason, it is particularly advantageous for the connection 14 by joining techniques to be carried out using a brazing or soldering process.

The second zone 3, with a cavity 15 between the honeycomb body 12 and the casing tube 1, adjoins the first zone 2 in the downstream direction 13. The cavity 15 is preferably filled with air, with the result that heat transfer from the honeycomb body 12 to the casing tube 1 is prevented in the region of the second zone 3. A distance 21 between the honeycomb body 12 and the second zone 3 is selected in such a way that contact with the casing tube 1 in the second zone 3 is prevented even in the event of thermal expansion of the honeycomb body 12.

The third zone 4 extends from the second zone 3 to the outlet end side 17. A connection 24 of the casing tube 1 to the honeycomb body 12 by joining techniques does not extend over the entire axial dimension 7 of the third zone 4.

The casing tube 1 is configured with a thickness 20 of 0.01 to 1.5 mm, with the result that the heat capacity of the casing tube 1 is reduced. Consequently, the casing tube 1 has a lower thermal mass and ensures rapid heating in the cold-start phase of a catalytic converter.

We claim:

1. A casing tube, comprising:

a first end face;

a first zone disposed downstream of and in a vicinity of said first end face, said first zone having a first internal diameter and an axial length of less than 5 mm;

a second zone disposed downstream of said first zone, said second zone having a second internal diameter being greater than said first internal diameter and an axial extent of 10-40 mm for preventing dissipation of heat;

a second end face; and a third zone disposed between said second zone and said second end face, said third zone having a third internal diameter equal to said first internal diameter.

2. The casing tube according to claim 1, wherein said axial length of said first zone is at least 1.5 mm.

3. The casing tube according to claim 1, wherein said second internal diameter is at least 0.4 mm greater than said first internal diameter.

4. The casing tube according to claim 1, wherein said second zone has an axial extent at least five times as great as a difference between said first internal diameter and said second internal diameter.

5. The casing tube according to claim 1, wherein said third zone has an axial extent with a dimension greater than at least one of a length of said first zone and a length of said second zone.

6. The casing tube according to claim 1, wherein said third zone has an axial extent of 10 to 50 mm.

7. The casing tube according to claim 1, wherein said first zone, said second zone and said third zone define a casing body having a thickness of 0.1 to 1.5 mm.

8. The casing tube according to claim 1, wherein said axial length of said first zone is less than 3 mm.

9. The casing tube according to claim 1, wherein said axial extent of said second zone is 10 to 20 mm.

10. The casing tube according to claim 3, wherein said second internal diameter is 2 mm greater than said first internal diameter.

11. The casing tube according to claim 3, wherein said second zone has an axial extent at least 10 times as great as a difference between said first internal diameter and said second internal diameter.

12. A catalytic converter, comprising:

a casing tube containing:

a first end face;

a first zone disposed downstream of and in a vicinity of said first end face, said first zone having a first internal diameter and an axial length of less than 5 mm;

a second zone disposed downstream of said first zone, said second zone having a second internal diameter being greater than said first internal diameter and an axial extent of 10-40 mm for preventing dissipation of heat;

a second end face; and a third zone disposed between said second zone and said second end face, said third zone having a third internal diameter equal to said first internal diameter;

a honeycomb body formed of sheet-metal layers and at least in part being structured such that an exhaust gas can flow through said honeycomb body in a given direction of flow, said honeycomb body having an inlet end side and said first zone of said casing tube disposed close to said inlet end side, said honeycomb body further having an outlet end side and said third zone disposed close to said outlet end side, and said honeycomb body connected to said casing tube by joining techniques performed in said first zone and said third zone.

13. The catalytic converter according to claim 12, wherein said honeycomb body and said second zone of said casing tube define a cavity there-between for holding air.

14. The catalytic converter according to claim 12, wherein said axial length of said first zone is less than 3 mm.

15. The catalytic converter according to claim 12, wherein the catalytic converter is used in an exhaust system of an internal combustion engine.

* * * * *